United States Patent [19]

Mankins

[11] Patent Number: 5,011,655

[45] Date of Patent: Apr. 30, 1991

[54] PROCESS OF FORMING A COMPOSITE STRUCTURE

[75] Inventor: William L. Mankins, Huntington, W. Va.

[73] Assignee: INCO Alloys International, Inc., Huntington, W. Va.

[21] Appl. No.: 455,498

[22] Filed: Dec. 22, 1989

[51] Int. Cl.[5] ..... B22F 3/00

[52] U.S. Cl. ..... 419/8; 419/31; 419/48; 419/53; 419/54; 419/57; 428/553; 428/558; 428/188; 428/681

[58] Field of Search ..... 419/8, 31, 48, 53, 54, 419/57; 428/188, 553, 558, 681

[56] References Cited

U.S. PATENT DOCUMENTS

| | | | |
|---|---|---|---|
| 4,283,464 | 8/1981 | Hascoe | 428/594 |
| 4,597,449 | 3/1986 | Lueth | 419/26 |
| 4,599,277 | 7/1986 | Brownlow et al. | 428/552 |
| 4,836,979 | 6/1989 | Bell et al. | 419/23 |

OTHER PUBLICATIONS

Implementation of Surface Mount Technology in High Reliability Products, by: Gregory L. Horton, Feb. 1987, pp. 781–802.

Military Moves Headlong into Surface Mounting, printed by Electronics, Jul. 10, 1986, copyright 1986, McGraw-Hill, Inc.

*Primary Examiner*—Stephen J. Lechert, Jr.

*Attorney, Agent, or Firm*—Francis J. Mulligan, Jr.; Blake T. Biederman

[57] ABSTRACT

The invention provides a method of manufacturing a thin metallic body composite structure. First, an inner layer of a first metal is cleaned to remove oxides and promote metallurgical bonding. The inner layer has a plurality of penetrating holes piercing the thickness of the inner layer. The penetrating holes are filled with metal powder of a second metal. Two outer layers of the second metal are placed on opposite sides of the cleaned and filled inner layer to form a sandwich structure. The sandwich structure is heated to a temperature at which recrystallization will occur in a non-oxidizing atmosphere. The sandwich structure is then hot worked to reduce thickness of the sandwich structure forming the thin metallic body composite structure.

20 Claims, 1 Drawing Sheet

FIG. 1
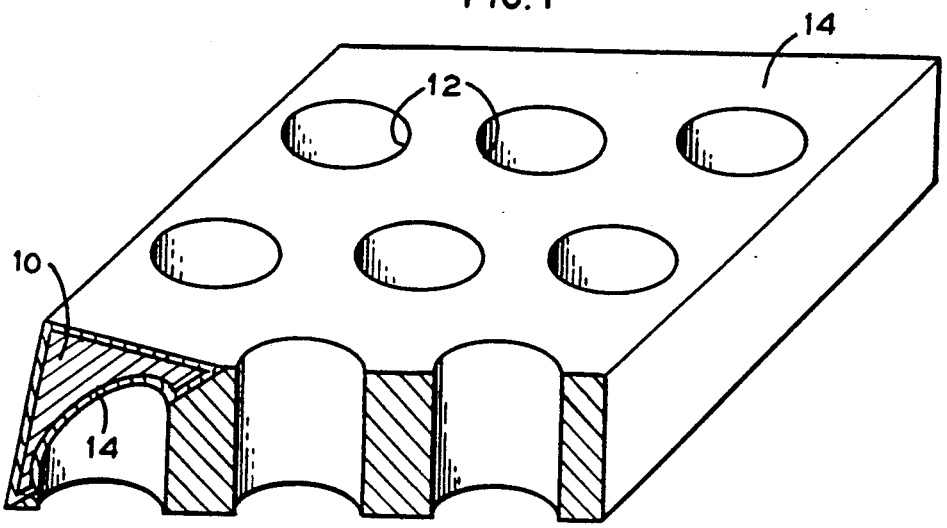
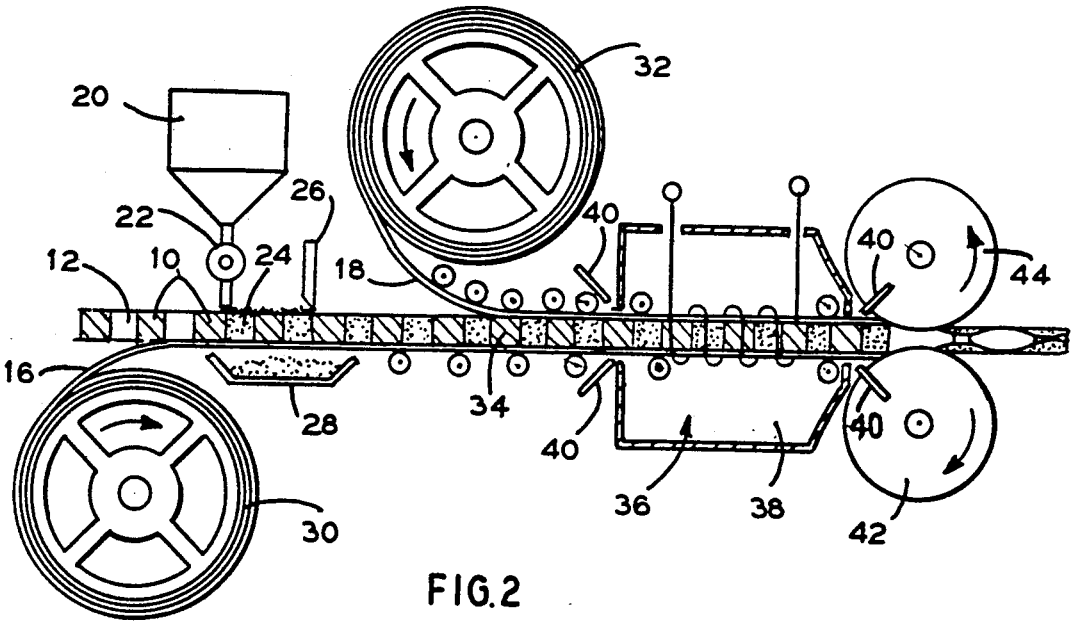
FIG. 2

PROCESS OF FORMING A COMPOSITE STRUCTURE

The present invention relates to a process of forming a metal composite structure. More particularly, the invention relates to a method of forming a composite having a low coefficient of thermal expansion and high electrical and heat conductivity.

BACKGROUND OF THE ART AND PROBLEM

Composite materials have been produced by a variety of different processes and techniques. Composite materials have been formed by casting one metal within another metal, cladding one metal to another, deforming or pressing two different metals together and variations of these methods. A problem with composite materials is the tendency for composites to have anisotropic properties. Inadequate bonding between the two materials of a composite can cause composites to be anisotropic and to perform at less than theoretical levels. Unclean surfaces, such as surfaces that contain metal oxides, interfere with bonding between two materials. Generally, bonds containing metal oxides have less than ideal properties.

Recently, in an attempt to produce a composite having a low coefficient of thermal expansion and a high thermal and electrical conductivity, a thin metallic composite structure was developed. The composite structure was formed by first piercing several holes through an inner layer of low coefficient of thermal expansion metal, placing two opposing layers of metal having high thermal and electrical conductivity on opposing sides of the inner layer to sandwich the inner layer and hot rolling the sandwiched inner layer. During the hot rolling, the outer layers plastically deform to fill the pierced holes of the inner layer. The inner layer may be electroplated after the piercing holes are made, to improve the bonding between the inner and outer layers during the hot rolling step. Although initial tests for the above method have performed satisfactory, it is believed that the method of the invention may in fact provide improved performance.

An object of the invention is to provide a method of producing thin metallic composite structures with improved bonding between metals of varied composition.

It is another object of the invention to provide a method of producing thin metallic composites having an inner layer completely filled with the metal of the outer layer.

It is another object of the invention to produce a metal composite having the demanding properties of low thermal expansion in combination with high thermal and electrical conductivity.

SUMMARY OF THE INVENTION

The invention provides a method of manufacturing a thin metallic body composite structure. First, an inner layer of a first metal is cleaned to remove oxides and promote metallurgical bonding. The inner layer has a plurality of penetrating holes piercing the thickness of the inner layer. The penetrating holes are filled with metal powder of a second metal. Two outer layers of the second metal are placed on opposite sides of the cleaned and filled inner layer to form a sandwich structure. The sandwich structure is heated to a temperature at which recrystalization will occur in a non-oxidizing atmosphere. The sandwich structure is then hot worked to reduce thickness of the sandwich structure forming the thin body metallic composite structure.

Preferably, prior to filling the penetrating holes with metal powder, a coating of metal substrate is electrodeposited on the inner layer to cover the inner layer and the penetrating holes of the inner layer. Most preferably, the electroplated metal substrate has the composition of the second metal. Ideally, the method of the invention is utilized for producing composites having a low coefficient of thermal expansion and having high electrical and heat conductivity properties.

BRIEF DESCRIPTION OF DRAWING

FIG. 1 is a schematic perspective view of an inner layer having a electrodeposited coating of a metal substrate, with a portion of the coated inner layer broken away; and FIG. 2 is a schematic view of the invention, illustrating filling penetrating holes of the inner layer, forming a sandwich structure, heating the sandwich structure and hot working the sandwich structure.

DESCRIPTION OF PREFERRED EMBODIMENT

The invention provides a novel method of forming a composite structure. The process of the invention assures complete filling of penetrating holes of an inner layer and metallurgical bonding between an inner layer and two outer layers to form a composite structure. The composite structure is produced in the form of a thin metallic body, which is especially useful for computer chip applications where a metal composite having a low coefficient of thermal expansion and high electrical and thermal conductivity is particularly advantageous.

Referring to FIG. 1, the process is initiated with an inner layer 10 formed of a first metal. The inner layer 10 has a plurality of penetrating holes 12 which pierce through the thickness of the inner layer 10. The holes 12 may be formed in any shape. However, it is preferred that the holes 12 utilized are cylindrically shaped and orthogonal to the length and width of the inner layer 10.

Inner layer 10 is introduced into an electrolytic bath, (not illustrated) where a coating of metal substrate 14 is electrodeposited on the surface of the inner layer 10 including walls of penetrating holes 12. The metal substrate 14 may be any metal which promotes bonding to the inner layer 10. Preferably, inner layer 10 is first cleaned of oxides before electrodeposition with any suitable pickling solution. Optionally, the inner layer 10 could be simply cleaned in a pickling operation without using the electrodeposition of a metal substrate 14. The preferred embodiment, as illustrated in FIG. 1, is to electrodeposit a metal substrate of a second metal used for the outer layers 16 and 18 (See FIG. 2) onto the inner layer. This electrodeposition of the second metal onto the first metal of the inner layer 10 provides for a clean bond between the inner layer 10 and outer layers 16 and 18 (See FIG. 2). The electrodeposited metal substrate 14 coating is preferably as thin as possible for improved metallurgical bonding to occur between inner layer 10 and outer layers 16 and 18. Metallurgical bonding enhances desired properties, especially thermal conductivity, electrical conductivity and low thermal expansion.

Referring to FIG. 2, a metal powder hopper 20 having a metering device 22 fills the penetrating holes 12 of the inner layer 10 with metal powder 24. Scraper blade 26 presses metal powder 24 into penetrating hole 12 against the lower outer layer 10 and scrapes excess metal powder 24 from the penetrating holes 12. Excess metal powder 24 is caught in metal powder basin 28 for return to metal powder hopper 20. Optionally, the powder may be supplied with a slurry binder. Lower and upper outer layers 16 and 18 are supplied from coils of strip 30 and 32. Lower and upper outer layers 16 and 18 are composed of a second metal composition. The upper outer layer 18 is then rolled onto metal powder 24 filled and cleaned or electrodeposited inner layer 10 to form a sandwich structure 34.

The sandwich structure 34 is then heated in a furnace 36 to a hot working temperature. Hot working temperature is defined by the temperature at which recrystalization occurs within the sandwich structure. Furnace 36 is filled with a non-oxidizing atmosphere 38 to prevent oxides from forming which reduces metallurgical bonding between the first and second metals of the inner layer 10 and the outer layers 16 and 18. A non-oxidizing atmosphere is defined as an atmosphere that will not significantly oxidize sandwich structure 34. The furnace 36 may be any known type of furnace capable of heating sandwich structures within a non-oxidizing atmosphere, such as an induction, direct electrical resistance or combustion type furnace. When a hydrogen containing furnace is used, burners 40 are used to burn combustible gas entering the atmosphere adjacent to where the sandwich structure 34 enters and exits furnace 36.

The thickness of the sandwich structure 34 is then reduced with roll compaction mill 42, while the sandwich structure 34 remains hot enough for recrystalization to occur. The sandwich structure 34 is reduced in thickness to become composite structure 44. When the sandwich structure 34 is reduced in thickness, the metal powder 24 and the outer layers 16 and 18 of a second metal are compressed to metallurgically bond with the first metal of inner layer 10. Having the metal powder 24 present, reduces the amount of deformation of the sandwich structure 34 necessary to fill the penetrating holes 12 of the inner layer 10. However, outer layers 16 and 18 deform to compress metal powder 24 and fill the top and bottom portions of penetrating holes 12. Alternatively, the lower outer layer 16 may be bonded to the inner layer 10 prior to filling metal powder 24 to prevent metal powder 24 from escaping penetrating holes 12 during the heating step. This facilitates reliable filling of the penetrating holes 12 with metallurgical type bonding occurring between the first and second metal within the penetrating holes 12.

The method of the invention is especially beneficial to composites designed to have a low coefficient of thermal expansion and a high thermal and electrical conductivity. To produce a composite with these features, preferably, the inner layer is constructed of a metal having a low coefficient of thermal expansion and the outer layer is constructed of a metal having high thermal and electrical conductivity. The high conductivity material is preferably selected from the metals aluminum, copper, silver, gold and alloys thereof. Most preferably, copper is used for the outer layers and copper powder is used to fill the penetrating holes. The inner layer may be any metal having a low coefficient of thermal expansion. Ideally, the inner layer selected is invar, an alloy containing about 36% nickel with a balance of essentially iron. The thickness of the outer layer and coating of metal substrate are limited to a thickness at which the bond to the inner layer effectively limits thermal expansion of the outer surface of the composite.

The following table illustrates materials and thickness for typical formation of composites having a sandwich structure thickness of 1.02 mm (0.040 inches) and containing holes having a diameter of 1.57 mm (1/16 inch). Typical packing density of holes is about 50 to 60 percent of theoretical.

| | 70% INVAR 30% COPPER COMPOSITE SANDWICH | 60% INVAR 40% COPPER COMPOSITE SANDWICH |
|---|---|---|
| Composition of inner layer | INVAR | INVAR |
| Thickness of inner layer (mm) | 0.89 | 0.77 |
| Holes (volume %) | 30 | 30 |
| Packing Density of Powder in Holes | 50 | 50 |
| Thickness of copper electroplated on inner layer, each side (mm) | 2 × 0.025 | 2 × 0.025 |
| Thickness of copper outer layer, each side (mm) | 2 × | 2 × |
| Total Thickness, mm | 1.02 | 1.02 |

The sandwich structure is then rolled to a desired thickness.

Invar may be continuously plated in a copper electroplating bath to plate copper having a thickness of 0.0254 mm by leading strip through the bath at a rate of 30.5 cm/min in a 6.1 m tank using a current density of 322 amperes per square meter. Prior to electrodeposition, the invar is preferably sent through a copper strike pickling solution to activate the invar for electroplating. Plating time calculations were made for an invar coil assuming that a 6.1 m length and a 0.15 m width of an invar strip to be in an electrolytic bath, a 20% surface area reduction to correct for lost surface area as a result of penetrating holes and that the surface area of the side edges to be essentially zero. Surface area of the invar coil in the electroplating bath was calculated as follows:

$$6.1\ \text{m} \times 0.15\ \text{m} \times 2\ \text{surfaces} \times (1.0\text{–}0.2\ \text{hole correction}) = 1.4\ \text{m}^2$$

Plating time was calculated as follows:

$$T = \frac{F \times 60\ \text{min/hr}}{CD}$$

where

T = Plating Time

F = Factor for Amp hr/m$^2$ to deposit 0.0254 mm = 94.7 for copper

CD = Current Density Amp/m$^2$ $$T = \frac{94.7\ \text{Amp hr/m}^2\ (60\ \text{min/hr})}{323\ \text{Amp/m}^2} = 17.6\ \text{min}$$

Assuming a 90% current efficiency there would be about a twenty minute residence time for the coil of invar in the above copper electroplating bath.

The copper invar sandwich structure containing copper powder in holes in the invar is preferably heated to a temperature between 750° C. and 900° C. prior to hot working. Most preferably, the preheat is to a temperature of about 815° C. for the desired rate of recrystallization during hot working. The heated copper invar sandwich structure is then reduced to a desired thickness to form a composite structure with metallurgical bonding for improved isotropic properties.

Copper invar composites have been found to operate best with penetrating holes occupying between 15 and 40 percent of the invar inner layer by volume. Most preferably, penetrating holes occupy about 30 percent by volume of the invar inner layer. This volume of copper through the invar has been found to produce the optimal electrical and thermal conductivity without significantly compromising the lowered thermal expansion property of invar. Typical penetrating hole diameters range from about 0.079 cm to about 0.159 cm, preferably about 0.159 cm (1/16 inch).

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process of manufacturing a thin metallic body composite structure comprising:

cleaning an inner layer of a first metal to remove oxides and promote metallurgical bonding, said inner layer having a plurality of penetrating holes piercing the thickness of said inner layer, filling said penetrating holes with metal powder of a second metal, placing two outer layers of said second metal on opposite sides of said cleaned and filled inner layer to form a sandwich structure, heating said sandwich structure in a non-oxidizing atmosphere to a temperature at which recrystalization will occur in said sandwich structure, and hot working said sandwich structure by reducing thickness of said sandwich structure to form said composite structure.

2. The method of claim 1 including the additional step of electrodepositing a coating of a metal substrate on said inner layer to cover said inner layer including walls of said penetrating holes of said inner layer.

3. The method of claim 1 wherein said inner layer comprises a metal having a low coefficient of thermal expansion and said outer layers comprise a metal of high electrical and heat conductivity.

4. The method of claim 1 wherein said outer layers are copper and said metal powder is copper powder.

5. The method of claim 4 wherein said sandwich is heated to a temperature between 750° and 900° C.

6. The method of claim 2 wherein said penetrating holes of said inner layer are between 15 and 40 percent by volume of said inner layer.

7. The method of claim 2 wherein said penetrating holes of said inner layer are about 30 percent by volume of said inner layer.

8. The method of claim 1 wherein said metal inner layer is invar.

9. The method of claim 2 wherein said penetrating holes are substantially cylindrically shaped and have a diameter between about 0.079 cm and about 0.159 cm.

10. The method of claim 2 wherein said penetrating holes are cylindrically shaped and have a diameter of about 0.159 cm.

11. A process of manufacturing a thin metallic body composite structure comprising:

introducing an inner layer of a first metal into a electrolytic bath, said inner layer having a plurality of penetrating holes piercing the thickness of said inner layer, electrodepositing a coating of metal substrate on said inner layer to cover the inner layer including said penetrating holes for promoting metallurgical bonding, filling said penetrating holes with metal powder of a second metal, placing two outer layers of said second metal on opposite sides of said coated and filled inner layer to form a sandwich structure, heating said sandwich structure in a non-oxidizing atmosphere to a temperature at which recrystalization will occur in said sandwich structure, and hot working said sandwich structure by reducing thickness of said sandwich structure to form said composite structure.

12. The method of claim 11 wherein said inner layer comprises a metal having a low coefficient of thermal expansion and said outer layers comprise a metal of high electrical and heat conductivity.

13. The method of claim 11 wherein the composition of said metal substrate electrodeposited on the inner layer is substantially similar to the second metal.

14. The method of claim 11 wherein said outer layers are copper.

15. The method of claim 14 wherein said sandwich is heated to a temperature between 750° C. and 900° C.

16. The method of claim 12 wherein said penetrating holes of said inner layer are between 15 and 40 percent by volume of said inner layer.

17. The method of claim 12 wherein said penetrating holes are about 30 percent by volume of said inner layer.

18. The method of claim 11 wherein said metal inner layer is invar.

19. The method of claim 12 wherein said penetrating holes are substantially cylindrically shaped and have a diameter between about 0.079 cm and about 0.159 cm.

20. The method of claim 12 wherein said inner layer is cleaned to remove oxides prior to introduction into said electrolytic bath.

* * * * *